United States Patent [19]

Gelli et al.

[11] 3,979,893

[45] Sept. 14, 1976

[54] MECHANICAL SYSTEM AND METHOD FOR CONTINUOUS WORKING WOOLEN TYPE YARN FROM CARDS TO SPINNING FRAME

[76] Inventors: Edo Gelli, Via M. Caorsi, 52; Giovanni Berti, Via Padova, 55, both of Prato, Italy

[22] Filed: Aug. 7, 1974

[21] Appl. No.: 495,431

[30] Foreign Application Priority Data

Aug. 6, 1973 Italy ..... 51872/73

[52] U.S. Cl. ..... 57/50; 19/150; 57/51.6; 57/77.4; 57/156

[51] Int. Cl.[2] ..... D01H 1/00

[58] Field of Search ..... 57/34 R, 36, 77.4, 50, 57/77.42, 51.6, 156; 19/150–153

[56] References Cited

UNITED STATES PATENTS

| | | | |
|---|---|---|---|
| 2,601,394 | 6/1952 | Hansen | 57/77.4 X |
| 2,748,558 | 6/1956 | Mullenschlader | 57/34 R |
| 2,778,186 | 1/1957 | Luttgen et al. | 57/50 |
| 2,995,002 | 8/1961 | Leach et al. | 57/50 X |
| 3,130,535 | 4/1964 | Royster | 57/34 R |
| 3,478,506 | 11/1969 | Kawashima | 57/50 X |
| 3,693,339 | 9/1972 | Henshaw et al. | 57/77.42 |
| 3,807,160 | 4/1974 | Pearce et al. | 57/77.42 |

*Primary Examiner*—John Petrakes
*Attorney, Agent, or Firm*—Kaufman & Kramer

[57] ABSTRACT

For working a web of woolen type yarns leaving a finisher card, a condenser head splits the web into parallel bands. The bands are delivered to pairs of rubbing rolls which reciprocate relative to one another to convert the bands to slubbings having false torsion. The slubbings are conveyed to spinning frames.

9 Claims, 5 Drawing Figures

MECHANICAL SYSTEM AND METHOD FOR CONTINUOUS WORKING WOOLEN TYPE YARN FROM CARDS TO SPINNING FRAME

BACKGROUND OF THE INVENTION

The present invention relates to woollen type yarn spinning and particularly a mechanical system and a process wherein the same is employed for continuous working woollen type yarns between the finisher card and spinning frame.

It is well known by the skilled in the art that in a spinning process of woollen type yarns, after the carding operation through two or more sets, a number of bands are split from the sheet or web of fibers by a "condensor", which pass the bonds on leather tapes to a series of double leather endless belts or "rubbers", and the reciprocating movement of these, rubs and compresses the fibers of each band into narrow, round untwisted slivers or slubbings (i.e. having a false or "mock" torsion) which are wound on to elongated spools to be generally mounted as coaxial spool pairs on a spinning frame, being ready to feed a section of same for the final spinning.

In most cases such slubbings are arranged as four coaxial and side-by-side elongated spools, and the "mock" torsion thereof is provided by the rubbing and compressing action of said double leather endless belts during the reciprocating movement of same.

When the winding phase of slubbings on to elongated spools through the condensor is completed, these elongated spools are collected and carried to the spinning frames to continue the spinning process as final spinning of the woollen yarn as desired.

Where prior art of woollen spinning is followed the result is a forced interruption in the process. The phases of the interruption are: (a) forming elongated spool of woollen slubbing through the condensers of prior art, which are provided with mechanical means for said purposes; (b) unloading said elongated spools and collecting same waiting for the next use on a spinning frame; and (c) carrying said elongated spools both for collection and loading of same on the spinning frames. The interruption results in a loss of time which is by-itself not indifferent, but also a consequently higher manufacturing cost.

SUMMARY OF THE INVENTION

A main object of the present invention is to eliminate these additional working phases by installation of a new mechanical system between the finisher card and spinning frame, which allows a continuous operation also from the one to other of these machines.

Another object of the present invention is to transfer, through a suitable belt conveyor, the card web or sheet of fibers up to the condenser head which, while being of a conventional type, operates only to split the entire width of a card web being transferred from the card doffer comb to the condenser head through said belt conveyor, in a number of bands arranged side-by-side, this number of bands being selected so that the total number of same be correspondent to the total number of spindles in the spinning frames employed for spinning woollen yarns as desired.

A further object of the present invention is to allow said fiber bands to be carried after the splitting operation, up to a pair of rolls which are driven for a rotating movement about their axes as well as a reciprocating motion along the same, but in opposite directions from one to the other roll in a roll pair, so that a rubbing action is applied to the split band placed therebetween and a slubbing having a "mock" or false torsion is produced which will be passed on to the draft roll head of the correspondent spinning frame for a final spinning.

A still further object of the present invention is to use for the spinning, not a single spinning frame only the spindle number of which is equal to the total split bands delivered by the condenser, i.e. equal to the slubbings obtained as above, but rather a set of spinning frames, each one having a partial number of spindles and being supplied with a correspondent number of slubbings delivered by the condenser after the rubbing action.

Another object of the present invention is to provide such a set of rubbing roll pairs for each one of the stated spinning frames, these roll rubbers being mounted and operated so that a single roll rubbing pair is substantially above the draft roll head of the correspondent spindle and the slubbing is fed evenly through a free falling thereof.

A further object of the present invention is to provide for the suitable synchronism between the carding set members, from the inlet to the outlet end of the set, the set of spinning frames wherein the slubbings being delivered from the condenser head and rubbers are worked, and further between all the operating members of said machines for carding, splitting, rubbing and final spinning.

DESCRIPTION OF THE DRAWINGS

Advantages resulting from the application of this new mechanical system and related working process will be evident to the skilled in the art. Some other features and object of the invention will however become apparent as the description of an exemplifying embodiment progresses, wherein the use of ring spinning frames is provided for the final spinning, with reference to the accompanying drawings in which.

DETAILED DESCRIPTION

Figure 1:
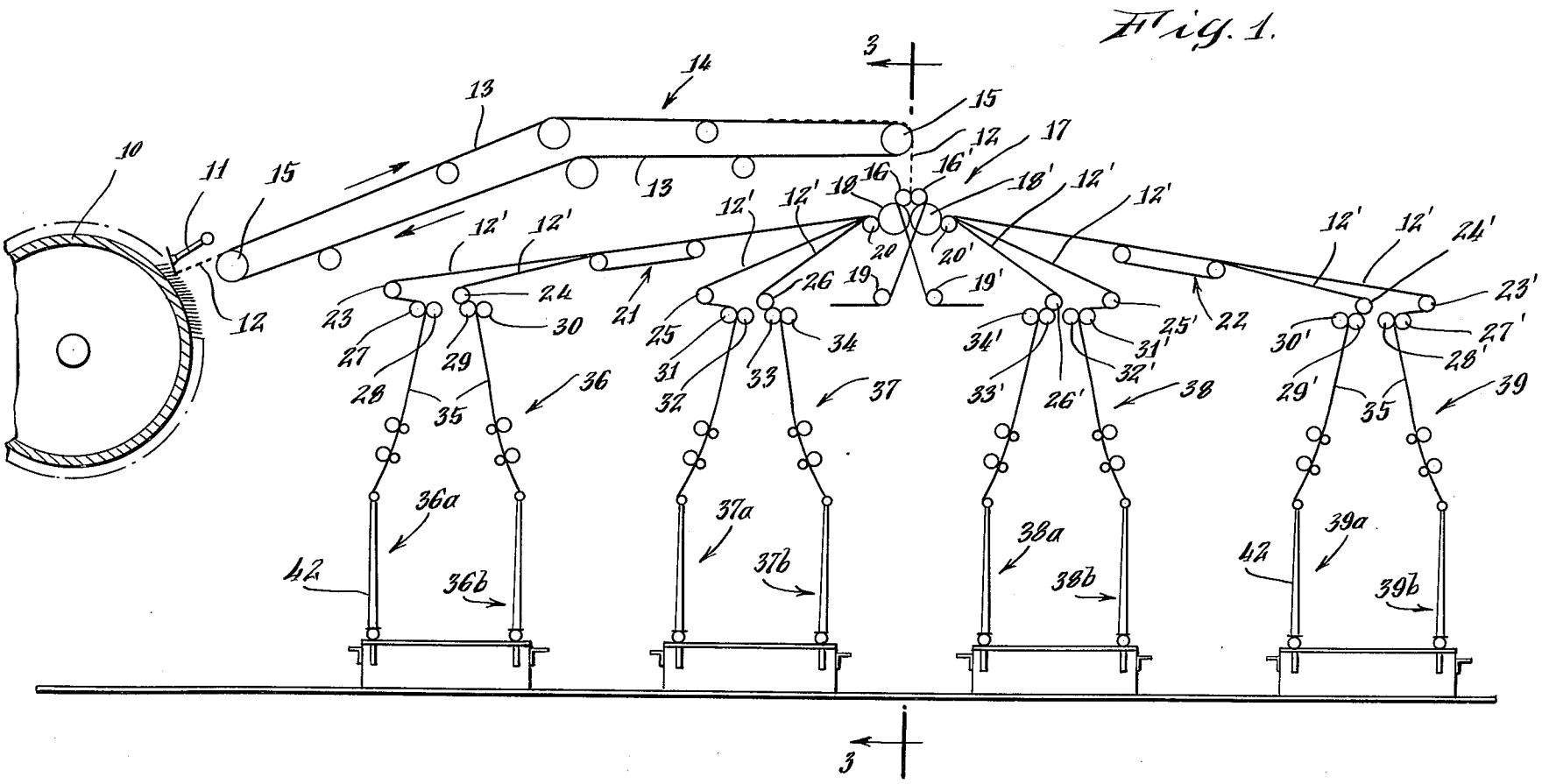
FIG. 1 is a schematic side elevation view of the working member unit between a finisher card and a spinning frame set, wherein the mechanical system of conveying, "condenser" and rubbing rolls to form a slubbing in accordance with the present invention are provided, so that a continuous working of woollen type yarn may be performed.
Figure 2:
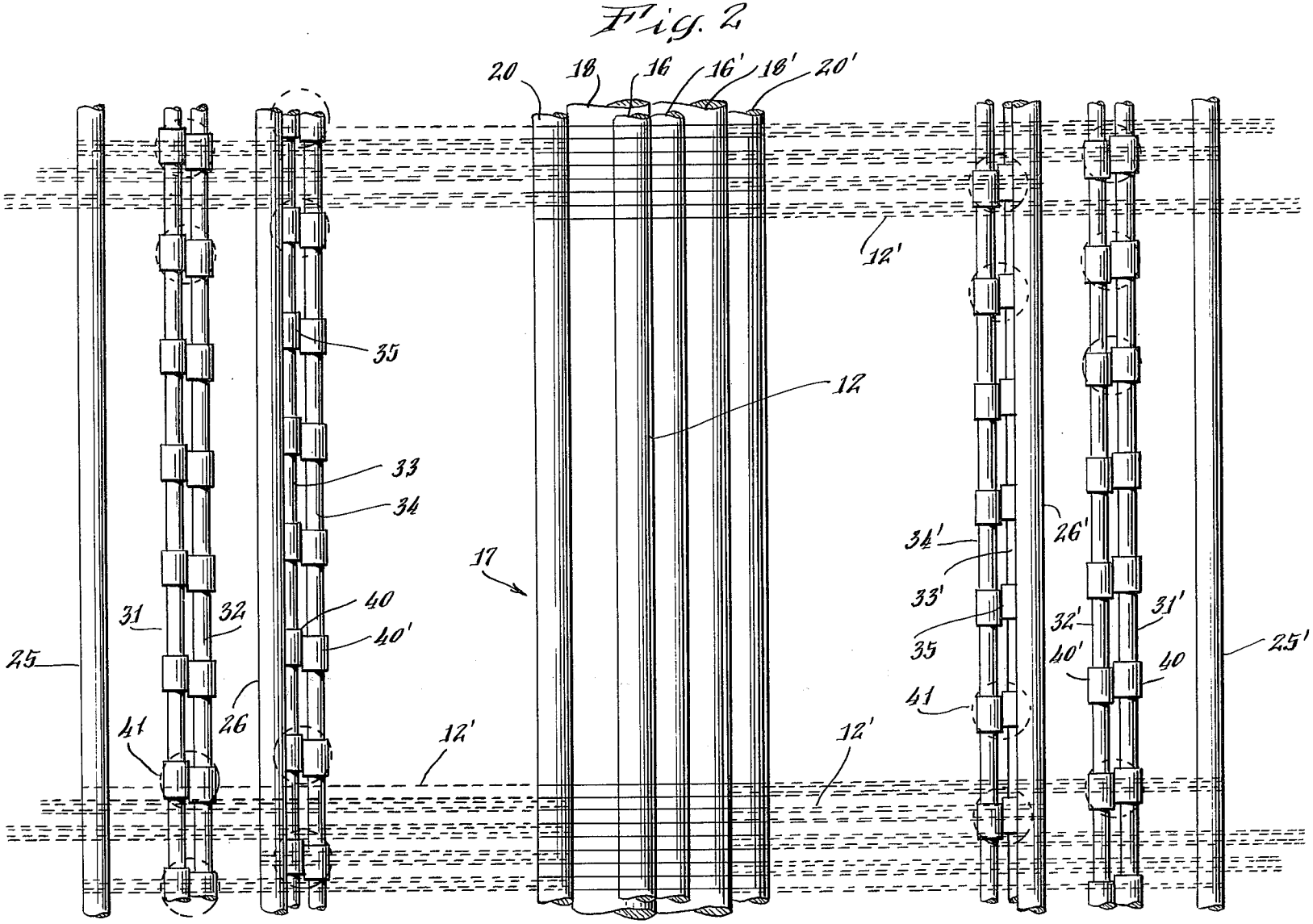
FIG. 2 is a schematic enlarged top view of the working member unit as in FIG. 1, but relating to the central part only of the condenser head and corresponding sections of spinning frames which are provided at both sides of said condenser head.
Figure 3:
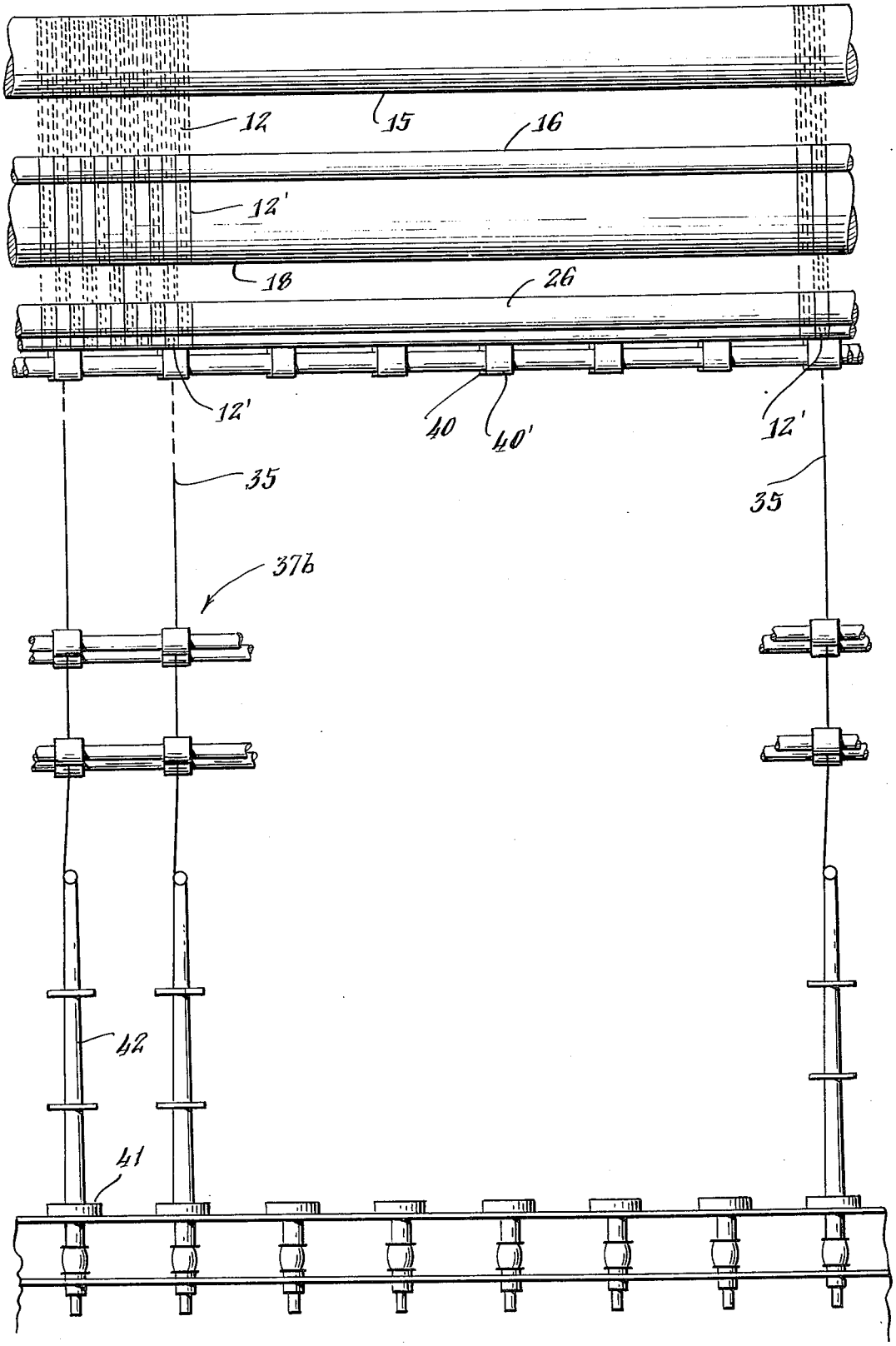
FIG. 3 is a partial schematic elevation view, taken along line 3—3 of FIG. 1.

Referring now to the drawings and first to FIGS. 1 and 2, the skilled in the art may have therethrough, while in a schematic form, the basic conception of the mechanical system in accordance with the present invention to perform a continuous working of woollen type yarn from the finisher card to the spinning frames. To clearly describe such a concept as well as for the correspondent illustrations, an example of mechanical system was selected in which the condenser head serves to supply a set of eight ring spinning frames, each one having a reduced number of spindles, and particularly four ring spinning frames the spindles of which are provided at both sides thereof.

From card doffer 10 of a conventional finisher card, a doffer comb 11 allows the doffed web or sheet of fibers 12 be passed on the upper run of belt conveyor 14, the motion of which is directed as shown by the arrows in FIG. 1. Belt conveyor 14 is suitably guided by means of guide rolls 15, and the guide rolls which are shown at the right end in FIG. 1 allows a free falling of the card web between the take-in rolls 16, 16' of condenser head 17. The width of belt conveyer 14, as well as the length of take-in rolls and condenser head 17 corresponds to the width of card doffer 10 and more particularly to the width of doffed card web 12.

The main rolls of condenser 17 are indicated in 18 and 18', as a pair of rolls to perform the splitting operation of the card web into a desired number of bands which are arranged side-by-side in the predetermined sequence being suitable for feeding into said eight sides of ring spinning frames. The related slubbings having a false torsion will then be spun as desired.

While condenser head 17 could be considered of a conventional type, in accordance with the present invention it is arranged and operates in somewhat different manner, to attain the desired aim of a continuous working. For this purpose it is located in the middle of spinning frames to be supplied, at a level which is above the highest spinning frame height. Roll pairs 16, 16' – 19, 19' and 20, 20' are to be considered as guide rolls, the first pair 16, 16 being the take-in rolls of card web, 19, 19' being the guide rolls for the correspondent narrow belts of the condenser, and 20, 20' being the guide rolls to doff split bands 12' which are directed to the left-hand and right-hand, respectively, as in FIG. 1.

For these split bands the motion of which is toward the left-hand and right-hand other guides 21, 22, respectively, are also provided, which are here shown as short belt-conveyers, while rolls 23, 24, 25, 26 and 23', 24', 25', 26' comprise the so-called lap plate conveyors to cooperate in taking-in the split bands between roll rubbing pairs 27,28–29,30–31,32–33,34 relating to the four spinning frame heads at the left-hand in FIG. 1 and 27', 28'–29',30'–31',32'–33',34', respectively, relating to the four spinning frame heads at the right-hand.

Employment of rubbing rolls or cylinders as a substitute for short double leather endless belt is not by-itself a novelty for condenser in woollen type yarn working. Two particular features are, however, to be pointed out in the present invention, namely: (1) arrangement of a single pair of rubbing rolls for each spinning frame to be fed, the position of which is remote from the condenser head; (2) employment of rubbing rolls which are provided with a synthetic material coating 40 upon the elongated sections of driven metal cylinders, which are similar to drafting rollers of some spinning machines. On the ground of practical experiments it was further found that a nylon coating is very suitable for an effective rubbing action in order to provide slubbings with false torsion to be supplied on to spinning frames for final spinning operation. This may be due to friction upon the slubbing, such a rubbing action being assisted by a self-lubrication which is very helpful for operative purposes.

In order to describe and illustrate the present invention, four double sided spinning frames only were assumed, the number of spindles in each side being reduced so as to spin slubbings 35 supplied from the rubbing roll pairs which are operating on bands 12' of the split card web 12 through condenser head 17. Conventional ring spinning frames 36, 37, 38, 39 were assumed, which are characterized only by the reduced number of spindles and spindle gauge, this letter substantially equal to the gauge slubbing 35 as formed respective bands 12' after said splitting operation through condenser 17.

Through the schematic illustration in FIG. 1 it should be apparent to the skilled in the art that the mechanical system and continuous working process from the finisher card to the spinning frames, in accordance with the present invention, are shown in the section of that FIG. 1 which is above spinning frames 36, 37, 38, 39. This mechanical system generally comprises a belt conveyor 14, condenser 17, rolls 23, 24, 25, 26 and 23', 24', 25', 26' for lap plates or split bands, and finally rubbing roll pairs 27, 28–29, 30–31, 32–33, 34 and 27',28' – 29',30' – 31',32' – 33',34', with related rubbing coating or bosses 40, 40'.

In this example of embodiment, the motion of card web 12 from card doffer 10, after the doffing action of comb 11, proceeds along a line of the doffer peripheral surface which is covered by the clothing, that is a line which is parallel to the card doffer axis, as usually in any cards. For purposes of illustration only, some data and indications are given which may be useful to better understand the present invention.

Where a card doffer width of 2200 mm is used, the useful width of the doffed card web may be assumed as about 2100 mm. Condenser 17 might split 184 bands to be supplied into correspondent eight spinning frames or, more exactly, four double side spinning frames, each side of which has 35 spindles with a spindle gauge of 90 mm. From each one of doffing rolls 20, 20' of condenser 17, split bands 12' are alternatively branched which pass on the lap plate rolls at the left-hand, and at the right-hand, as in FIG. 1. Each one of these rolls being involved in the motion of one to eight bands being delivered from the condenser. The feed sequence of the eight sides of the spinning frames wherein spindles 42 are mounted was assumed as listed in Table 1, and the numeration is intended from the first split band and first spindle up to the 184th and 23rd, respectively, at the opposite side of condenser 17 and spinning frames 36,37,38,39.

This distribution sequence of split bands supplied by condenser 17 as slubbing to be spun is repeated every eight bands in each spinning frame head, so that in Table 1 was considered as sufficient to list the first two sets of bands only, i.e. I to VIII and IX to XVI, relating to the first and second spindle, respectively, of each spinning head:

Table I

| Band No. | Spinning frame | Spindle No. | Band No. | Spinning frame | Spindle No. |
|---|---|---|---|---|---|
| I | 36a | 1 | IX | 36a | 2 |
| II | 38a | 1 | X | 38a | 2 |
| III | 36b | 1 | XI | 36b | 2 |
| IV | 38b | 1 | XII | 38b | 2 |
| V | 37a | 1 | XIII | 37a | 2 |
| VI | 39a | 1 | XIV | 39a | 2 |
| VII | 37b | 1 | XV | 37b | 2 |

Table I-continued

| Band No. | Spinning frame | Spindle No. | Band No. | Spinning frame | Spindle No. |
|---|---|---|---|---|---|
| VIII | 39b | 1 | XVI | 39b | 2 |

As said above, synchronization between the different operative members of machines is provided. It will be apparent to the skilled in the art that, unlike conventional woollen type spinning systems, continuous working needs not only a synchronization in the carding set, but also between finisher card doffer and this new mechanical systems for transferring card web 12, as well as for splitting bands 12', forming slubbings 35 and supplying the spinning frames for the final spinning operation. While no drive member or means are shown in the drawings, it will be apparent that in practice the adaptation and regulation of conventional drive means will be sufficient to meet above requirements of operative synchronism. It was then possible to simplify the illustrations.

As regards the yarns it may be, for example, provided for a starting synchronism between finisher card 10 and second double side spinning frame 37, in order to then provide for the synchronization of the other spinning frames 36,38,39 by using suitable drive means.

The mechanical system which comprises belt conveyor 14, condenser head 17, rubbers or rubbing rolls 27,28 . . . 33,34 and 27',28' . . . 33',34' and related guide rolls could form a single unit having members which are connected therebetween, the control of same being, for example, derived from card 10 or said spinning frame 37.

For the skilled in the art, the requirements of such a synchronism does not result as a problem or a trouble as regards the realization thereof. Same considerations may be done for eventual modifications or changes which relate, for example, to the predetermined position of the condenser head, preferred use of spinning frames having spindles on a single side only, preferred use of rubbing roll pairs as a part of the spinning frame having the desired reduced spinning spindle number and consequent insertion of each pair of rubbers in the driving system of said spinning frame, etc.

More particularly, a consideration may be made about an arrangement of the card doffer comb which is not in a conventional manner, as schematically shown in FIG. 1, but in a lower position below the card doffer, so that the mechanical system of the present invention as well as the spinning frames will then be located on a floor at a lower level in respect to card 10. In this manner doffed web 12 will fall by gravity on to the underlying belt conveyor 14, that is because of its own weight only, for being fed towards condenser head 17, or even directly between the take-in rolls of said condenser head.

Figure 4:
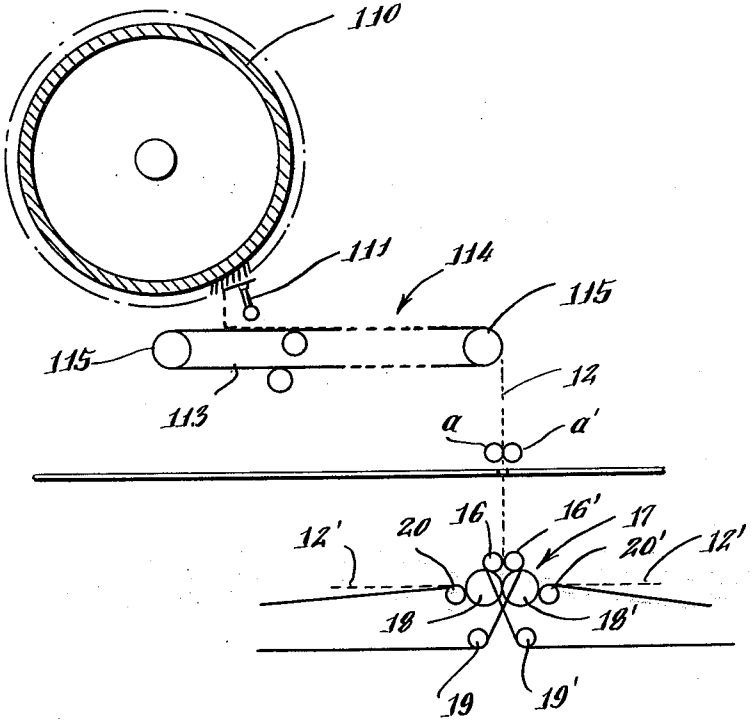
FIG. 4 is a schematic side elevation view of a modified arrangement between finisher card doffer and belt conveyor to supply a card web on to the condenser head.

In FIG. 4 a modified embodiment of the finisher card is shown, wherein the doffing card comb 111 has its axis in offset position of about 90° clockwise in respect to a conventional card comb 11 as in FIG. 1. Belt conveyor 114 is, in this case, placed directly below the right-hand end portion of card doffer 110, so that the doffed web 112 is falling by gravity along its entire width on to belt conveyor 114, to be transferred towards a condenser head (not shown) similar to condenser head 17 of FIG. 1. Slubbings will then be supplied to the spinning frames for the final spinning thereof, and a set of spinning frames having a reduced spindle number will be used in accordance with the present invention. In such a schematic illustration it was assumed that belt conveyor 114 has horizontal upper and lower runs, doffed card web is falling by gravity from guide roll 15 and passing between roll pair *a, a'*, so that a better guide towards the condenser head (not shown) is obtained, which is arranged on a lower floor.

It will be understood that, when such an arrangement is used, a level difference is necessary between the floors for finisher card and the unit formed by the mechanical system in accordance with the present invention (see FIG. 1) together with the spinning frames having a reduced number of spindles.

That arrangement may be suggested not only for supplying by gravity the doffed card web 112 on to underlying belt conveyor 114, but also where for any reason the installation of spinning machines on floors at different levels is preferred.

Figure 5:
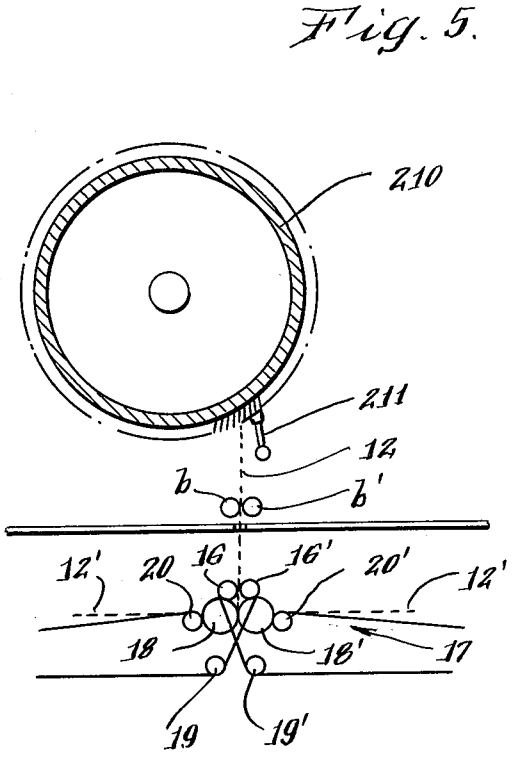
FIG. 5 is a schematic side elevation view of another embodiment for continuous working between finisher card and condenser, the card web being supplied to the taker-in rolls of the condenser directly, by gravity feed.

In FIG. 5 a direct passage from card doffer 210 to condenser head 217, is illustrated doffed card web 211 being supplied by gravity between a pair of smooth intermediate guide rolls *b, b'*, before its feeding between take-in rolls 216, 216' of condenser head 217, similar to the above modified embodiment shown in FIG. 4.

Selection of this further embodiment, always where the installation on two different level floors one upon the other is preferred for the card and for condenser of the new mechanical system with related spinning frames, respectively, has the advantage of direct supplying condenser 217, without employing any intermediate belt conveyor, as at 14 (FIG. 1) or 114 (FIG. 4).

The advantages of properly using a predetermined surface area for machine installation, as described above and shown in FIGS. 1 to 3 and 4, may be confirmed and further increased when the arrangement on to floors at different levels as in FIG. 5 is possible and then preferred.

While the invention has been described and illustrated in its preferred and modified embodiments, it should be understood that some other embodiments and/or arrangements may be chosen by the skilled in the art, which must be considered as falling within the scope of the invention when based on the inventive principles thereof.

We claim:

1. For use with a finisher card having a doffer and comb and one or more spinning frames having drafting rolls and spindles, a system for working woolen type yarns while moving the yarns from the finisher card to the spinning frames comprising:

a. a condenser head for receiving an undivided card web from the finisher card and for splitting the web into a number of parallel bands.

b. pairs of parallel elongated, rubbing rolls which rotate about and reciprocate along their longitudinal axis relative to one another, each of said pairs being located closely adjacent to the drafting rolls of an associated spinning frame and receiving and operating on at least one of the parallel bands produced by said condenser head to impart a false torsion to the band before the band is delivered to said closely adjacent drafting rolls of said associated spinning frame.

2. A system as recited in claim 1 further including a first conveying means interposed between the finisher card and the condenser head for transferring the undivided card web from the finisher card to the condenser head.

3. A system as recited in claim 2 wherein the comb of the finisher card is positioned near the lowest point of the card doffer so that the doffed web is fed to the first conveying means by force of gravity.

4. A system as recited in claim 1 wherein the undivided web is fed vertically into the condenser head and wherein the system further includes a plurality of second conveying means for transferring each of the parallel bands to one of the pairs of elongated rubbing rolls.

5. A system as recited in claim 4 wherein the comb of the finisher card is positioned near the lowest point of the card doffer and the condenser head is positioned directly below the comb so as to receive the undivided web by force of gravity.

6. A system as recited in claim 1 wherein the condenser head is located directly below the delivery end of said belt conveyor.

7. A system as recited in claim 6 further including a plurality of second conveying means for the transferring each of the split bands from the condenser head to one of the pairs of elongated rubbing rollers.

8. A process for continuous working of woolen type yarns doffed in an undivided web by a finisher card comprising the steps of a. delivering the undivided web to a condenser head;

b. splitting the undivided web at the condenser head into a number of parallel bands;

c. passing each of said bands through a pair of rotating, rubbing rollers which are reciprocated along their longitudinal axis relative to one another to convert the band to a slubbing having a false torsion; and d. transferring each of the slubbings to closely adjacent drafting rolls of an associated spinning frame.

9. A process as recited in claim 8 wherein the step of delivering the undivided web to a condenser head further includes the step of gravity feeding the web into the head along a free fall vertical path.

* * * * *